US009790715B2

(12) United States Patent
Bouan

(10) Patent No.: US 9,790,715 B2
(45) Date of Patent: Oct. 17, 2017

(54) ANTI-THEFT DEVICE INTENDED TO BE ATTACHED TO AN ITEM SOLD OVER-THE-COUNTER

(71) Applicant: FORS FRANCE, Champigny sur Marne (FR)

(72) Inventor: Bruno Bouan, La Varenne Saint Hilaire (FR)

(73) Assignee: FORS FRANCE, Champigny sur Marne (FR)

( * ) Notice: Subject to any disclaimer, the term of this patent is extended or adjusted under 35 U.S.C. 154(b) by 0 days.

(21) Appl. No.: 14/900,201

(22) PCT Filed: Jun. 20, 2014

(86) PCT No.: PCT/FR2014/051552
§ 371 (c)(1),
(2) Date: Apr. 13, 2016

(87) PCT Pub. No.: WO2014/207356
PCT Pub. Date: Dec. 31, 2014

(65) Prior Publication Data

US 2016/0258192 A1 Sep. 8, 2016

(30) Foreign Application Priority Data

Jun. 28, 2013 (FR) ..... 13 56327
Feb. 18, 2014 (FR) ..... 14 51287

(51) Int. Cl.
*E05B 73/00* (2006.01)
*G08B 13/24* (2006.01)
(Continued)

(52) U.S. Cl.
CPC ..... *E05B 73/0017* (2013.01); *E05B 37/00* (2013.01); *E05B 39/002* (2013.01);
(Continued)

(58) Field of Classification Search
CPC .. E05B 73/00; E05B 73/0017; E05B 73/0023; E05B 73/0029; E05B 73/0041; E05B 73/0047; E05B 73/0052
See application file for complete search history.

(56) References Cited

U.S. PATENT DOCUMENTS 4,221,025 A * 9/1980 Martens ..... E05B 73/0017 24/704.1
5,019,801 A * 5/1991 Anderson, III ..... E05B 73/0017 340/522

(Continued)

FOREIGN PATENT DOCUMENTS

EP 0702040 A2 3/1996
WO 0129354 A1 4/2001

(Continued)

*Primary Examiner* — Christopher Boswell
(74) *Attorney, Agent, or Firm* — Bachman & LaPointe, P.C.

(57) ABSTRACT

An antitheft device attachable to an article, formed by two parts, one part comprises a means for remote interaction with a terminal detecting passage of the device, a hinge to allow movement between a protection position, and a release position, one of the parts having, at the end opposite to the movable hinge, a needle able to move in a direction perpendicular to the mid-plane of the device, the other part comprising a housing for receiving the needle, the housing comprising lock configured to allow the release of the needle with an opener, wherein the first part has three retractable cages enabling the needle to move between a retracted position where the tip of the needle does not project beyond the internal surface of the first part, and a deployed position in which the needle is engaged in the complementary housing when the device is in the closed position.

20 Claims, 20 Drawing Sheets

(51) Int. Cl.

| | |
|---|---|
| ***E05B 37/00*** | (2006.01) |
| ***E05B 39/00*** | (2006.01) |
| ***E05B 41/00*** | (2006.01) |
| ***E05B 45/00*** | (2006.01) |
| ***E05B 51/00*** | (2006.01) |
| *E05B 45/06* | (2006.01) |
| *E05B 63/00* | (2006.01) |

(52) U.S. Cl.
CPC ..... *E05B 41/00* (2013.01); *E05B 45/00* (2013.01); *E05B 51/00* (2013.01); *E05B 73/0041* (2013.01); *G08B 13/2434* (2013.01); *E05B 2045/065* (2013.01); *E05B 2063/0026* (2013.01)

(56) References Cited

U.S. PATENT DOCUMENTS

| | | | | |
|---|---|---|---|---|
| 5,022,244 | A * | 6/1991 | Charlot, Jr. ..... | E05B 73/0017 24/706.8 |
| 5,068,641 | A * | 11/1991 | Hogen Esch ..... | E05B 73/0017 340/551 |
| RE35,361 | E * | 10/1996 | Hogan ..... | E05B 73/0017 24/704.1 |
| 6,255,950 | B1 * | 7/2001 | Nguyen ..... | E05B 73/0017 340/572.8 |
| 6,449,991 | B1 * | 9/2002 | Hogan ..... | E05B 73/0017 24/600.7 |
| 7,190,272 | B2 * | 3/2007 | Yang ..... | E05B 73/0017 340/568.1 |
| 7,342,495 | B2 * | 3/2008 | Sayegh ..... | E05B 73/0017 24/704.1 |
| 2006/0070410 | A1 | 4/2006 | Fuss et al. | |
| 2007/0152836 | A1 * | 7/2007 | Nagelski ..... | E05B 73/0017 340/572.9 |

FOREIGN PATENT DOCUMENTS

| | | | |
|---|---|---|---|
| WO | 2006106536 | A1 | 10/2006 |
| WO | 2012020105 | A1 | 2/2012 |

* cited by examiner

ANTI-THEFT DEVICE INTENDED TO BE ATTACHED TO AN ITEM SOLD OVER-THE-COUNTER

BACKGROUND

The invention relates to the field of antitheft devices intended to protect articles sold over the counter. The most widespread solution for protecting the articles is indisputably the system consisting of electronic walk-through scanner with associated labelling.

These labels use devices provided with a means interacting with a walk-through scanner equipping the exit zones beyond the tills, and triggering an alarm when a customer attempts to leave the shop without having paid for the article to which the antitheft device is fixed.

The checkout girl has an opener for removing the device from the article when passing the till.

The antitheft devices are configured according to the shape and nature of the article to be protected. The present invention relates more particularly to antitheft devices intended to protect garments such as shoes, leather goods, fabrics, fashion accessories, undergarments, etc, without this list being limiting.

For this type of article, providing an antitheft device formed by two parts is known in the prior art. One of the parts has a tip that can pass through a hole in the article or perforate a fabric. This tip comes to be housed in a cavity provided on the complementary part that provides locking thereof. In this case, the locking of the tip prevents the unlocking of the antitheft device. This cavity comprises a locking system that holds the tip firmly when it is engaged in the second part. Release thereof is possible only with a specific opener.

The American patent application US 2006/070410 is known in particular, describing an antitheft device consisting of two articulated elements that are clamped together removably around a tubular article intended to be protected. One of the elements is extended at its end by a needle, the other element being provided with a housing comprising means for locking the end of the needle when the two elements are in the closed position.

The international patent application WO 0129354 is also known, describing a rivet for a security label, formed by a hollow housing comprising a head extended by a needle able to move between a position retracted inside the housing and a deployed position, this assembly being separable from the security label.

The patent WO 2006/106536 is also known, describing an antitheft security label comprising a first closure element provided with a nail, and a second closure element provided with means for gripping said nail. The label has a housing for receiving the nail, formed by a cylindrical seat. A sealing ring protects the end of the nail in the retracted position.

The patent application WO 2012/020105 describes an antitheft device of the type with a pin and a plate for holding the pin, comprising a head that supports a spindle. The head and plate are suitable for enclosing between them, like a sandwich, part of a garment article that has the pin passing through it. The head comprises a cap intended to protect the pin, which may be extended reversibly by elastic means from a configuration for engagement of the pin, with the protective cap substantially retracted in the head, into a configuration for disengaging the pin, with the protective cap extending from the head so as to surround the pin as far as the end of its tip.

The patent EP 00702040 is also known, describing a detector for protecting against the theft of articles, comprising an alarm circuit electrically connected to one end of at least one conductor and to the other end of the conductor by the mechanical putting in contact of a female element and a male element passing through the article to be protected.

The male element is a needle that is electrically conductive and conical over its entire length and said female element is formed by a housing, the cover of which comprises a hole and in which an electrically insulating plate comprises a hole in the same axis as the hole and with a diameter slightly greater than the largest diameter of the needle. The end of the conductor being connected to a contact point of the plate. The other end of the conductor is connected to a second contact point of the plate by the needle and two electrically-conductive wires fixed tangentially to the plate so as to be put in mechanical and electrical contact with the needle when it penetrates the holes.

The solutions of the prior art are not fully satisfactory.

The first drawback is that the tip intended to pass through the article to be protected is invasive and may injure the user when fitting the device on an article or removing it, in particular in the case where the tip fits flush with the surface of the device in the open position.

The second drawback, for some solutions, is that the tip follows a curved path in which it is facing the reception orifice only when the arms are properly positioned. The least lateral force prevents the tip penetrating the reception orifice.

The third drawback is that these solutions of the prior art are limited to one type of article and do not have flexibility for more universal use, for articles with a different thickness or configuration.

A fourth drawback is the vulnerability of the device of the prior art in the event of abrupt impact on the device. In this case, it is usual for the locking means to release the needle in an unwanted fashion, which enables a thief to remove the device and thus defeat the alarm device which is provided in the shop.

SUMMARY

In order to remedy the first three drawbacks, the present invention relates, in its most general acceptance, to an antitheft device intended to attach an article sold over the counter, formed by two parts, one of which comprises a means for remotely interacting with a terminal detecting the passage of such a device, said parts being articulated by a hinge in order to allow movement between a protective position in which they interact with a part of the article to be protected in order to prevent the separation of the antitheft device on the article, and a release position in which they enable the article to be removed, one of the parts having, at the end opposite to said movable hinge, a needle able to move in a direction perpendicular to the mid-plane of the device, the other part comprising a housing for receiving said needle, the housing comprising locking means configured so as to allow the release of said needle by means an opener, characterised in that said first part has three retractable cages, enabling said needle to move between a retracted position in which the tip of said needle does not project beyond the internal surface of the first part, and a deployed position in which said needle is engaged in the complementary housing when the device is in the closed position.

Preferably the external cage has an internal hollow volume corresponding to the external volume of the intermediate cage, said intermediate cage having an internal hollow volume corresponding to the external volume of the internal cage, the height of the intermediate cage being configured so as not to project beyond the top front surface of the external cage, the height of the internal cage being configured so as not to project beyond the top front surface of the external and intermediate cages in the locking position.

According to a variant, the locking means consists of at least one ball pushed by a spring towards the bottom of the housing intended to receive the needle, said housing having a frustoconical shape intended to cause a wedging of the ball against the needle, said ball being able to interact with an unlocking means in order to oppose the action of said spring.

Advantageously, the locking means further comprises a means for the lateral blocking of said frustoconical housing, said lateral blocking means being able to interact with an unlocking means for releasing the axial movement of said housing.

According to a first variant, the locking means consists of at least one ball pushed by a spring towards the bottom of the housing intended to receive the needle, said housing having a conical shape intended to cause a wedging of the ball against the needle, said ball being able to interact with an unlocking means in order to oppose the action of said spring.

According to a second variant, the locking means consists of a blade configured so as to prevent the movement of the needle at rest and to interact with the unlocking means in order to release said needle.

Advantageously, said first and second parts are configured so as to delimit a transverse window.

According to a particular embodiment, the ends of said first and second parts are configured so as to configure a surface holding the article to be protected.

In order to respond also to the aforementioned fourth drawback, said second part is extended in line with the needle by a damper.

According to a first variant, said damper consists of an elastically deformable piece.

According to a second variant, said damper consists of a piece able to move axially and damped by a spring.

The invention also relates to means for increasing the efficacy of the protection.

According to a first variant, one of said parts contains a capsule filled with a marking substance.

According to a second variant, one of said parts has at least one transparent zone.

According to a third variant, at least one of said parts has on its internal surface a surface finish reinforcing the mechanical interaction with the article to be protected.

According to a fourth variant, said parts have on their internal surfaces elements with a complementary surface for reinforcing the cooperation with a thin deformable article to be protected.

According to a fifth variant, said parts have an arched shape in order to surround a cylindrical region of an article to be protected.

Advantageously, the antitheft device according to the invention constitutes one of the elements of a series of antitheft devices distinguished from one another by a coloured code.

BRIEF DESCRIPTION OF THE DRAWINGS

The invention will be understood better from a reading of the following description, referring to the accompanying drawings concerning non-limitative example embodiments, where.

DETAILED DESCRIPTION

Figure 1:
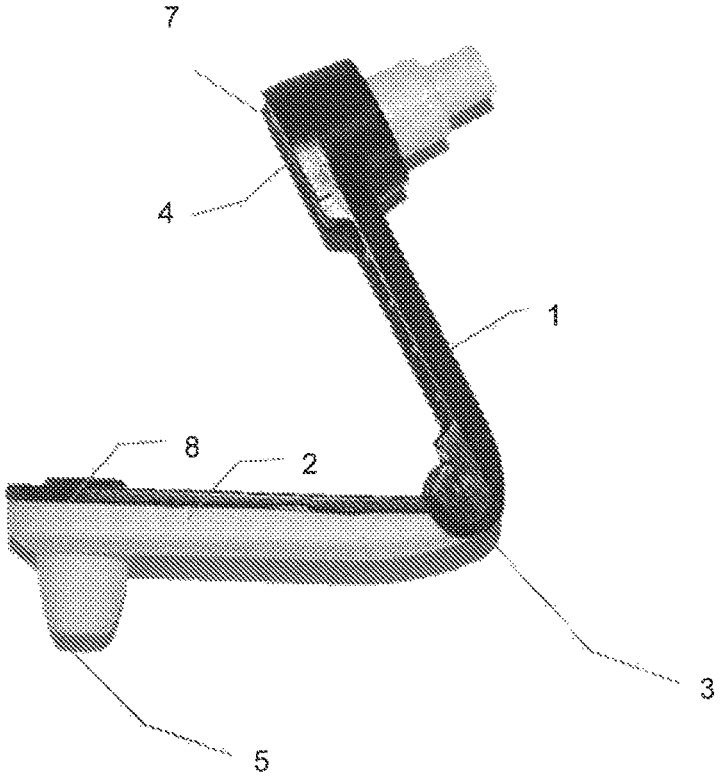
FIGS. 1 and 2 depict views of the device respectively in the open position and in the closed position
Figure 2:
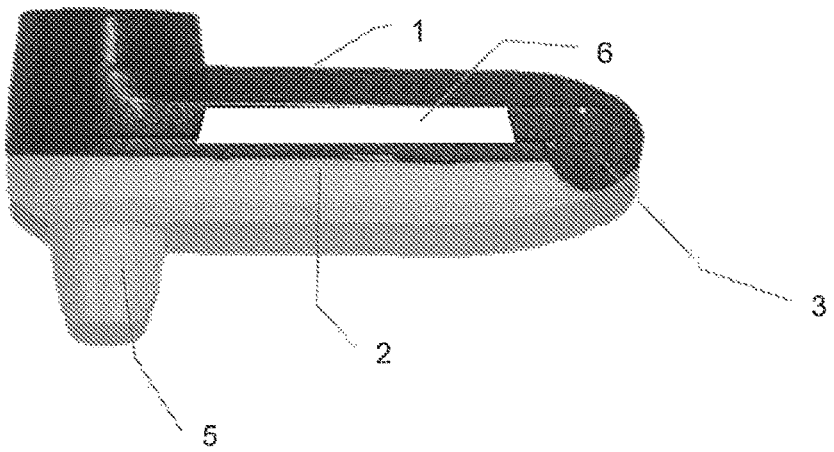

FIGS. 1 and 2 depict views of the device respectively in the open position and in the closed position.

It is formed by two arms (1, 2) connected by an articulation (3). These arms (1, 2) are roughly parallelepipedal in shape, slightly arched in order to form, in a closed position, a transverse cavity (6). The first arm (1) is extended perpendicularly by a needle (4). The other arm (2) is provided with a perpendicular extension (5).

The end (7) of the first arm (1) forms a plate coming into contact with a complementary plate (8) provided at the end of the second arm (2) when the device is in the closed position.

This device may be used for various types of article:

- thin articles having eyelets, such as shoes, fashion accessories, garments and undergarments, etc: in this case, the needle (1) passes through one of the eyelets in the article
- textile articles: in this case, the needle (4) perforates an area of the article that is not very fragile
- articles having a sleeve or a strap: in this case, the device is closed in order to house the sleeve or strap in the window (6). This window may for this purpose a rectangular or round cross-section or any other suitable shape.

Figure 3:
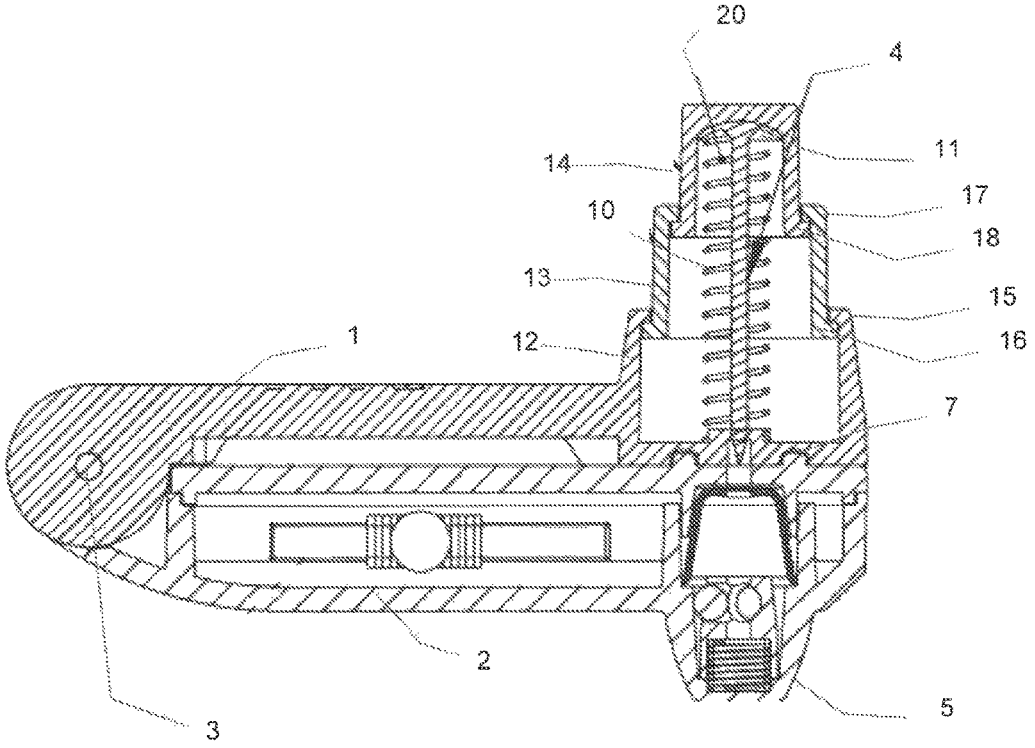
FIGS. 3 and 4 depict views in cross-section of the closed device respectively in the unlocked position and in the locked position
Figure 4:
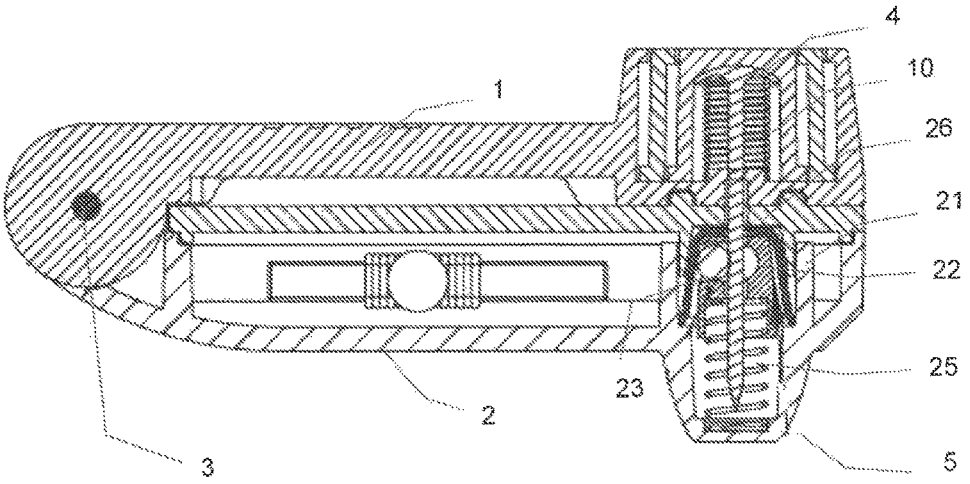

FIGS. 3 and 4 depict views in cross-section of the closed device respectively in the unlocked position and in the locked position.

In the unlocked position, the needle (4) is pushed into the retracted position by a spring (10) that comes into abutment against an annular shoulder (11) provided at the head of the needle (4). This spring bears on the side opposite to the plate (7) forming the end of the first arm (1).

The needle (4) is smooth, to avoid ruining the protected article when it passes through a fabric. It may also have flutes for improving the holding by locking balls.

The needle is actuated by a set of three retractable cages (12, 13, 14) fitting together.

The first cage (12) is fixed. The intermediate cage (13) is able to move in axial translation with respect to the first cage (12). The interior cage (14) is able to move in axial translation with respect to the intermediate cage (14).

The first cage (12) has a cylindrical shape. It has the largest cross-section. It is fixed and secured to the plate (7). It has a tubular internal surface, guiding the second cage (13) able to move in axial translation with respect to the first cage (12).

The top end of the first cage has an annular internal shoulder (15) reducing the cross-section and delimiting a passage for the second cylindrical cage (13).

This second cylindrical cage (13) also having a tubular internal surface, guiding the internal cage (14).

The intermediate cage (13) has, at its bottom part, an annular external shoulder (16) with an external cross-section complementary to the internal cross-section of the cage (12), to provide movement and guidance. This shoulder (16) comes into abutment against the internal annular shoulder (15) of the external cage (12) and prevents removal of the second cage with respect to the first cage (12).

The second cage (13) also has at its top part an annular internal shoulder (17) reducing the cross-section and delimiting a passage for a third frustoconical cage (14) having at its bottom part an external annular shoulder (18) limiting movement and preventing removal of the third cage with respect to the second cage (13).

The bottom of the third cage (14) is closed by a bottom (20) constituting an internal stop against which the head of the needle (4) comes to bear, and the external surface of which forms a pressing zone enabling the user to push the needle into its receptacle (5).

The travels of the two intermediate and internal cages (13, 14) are substantially useful, so that the amplitude of the movement of the tip of the needle (14) is approximately twice as great as the variation in height of the locking button, between the open position and the locked position. This reduces the overall size of the device while keeping a useful travel allowing effective locking.

Naturally the invention could also provide a higher number of movable cages.

By exerting an axial force on the bottom of the third cage (14), the engagement of the three cages in one another is caused, which reduces their height and enables the needle to project beyond the surface of the front zone (7) of the first arm in order to engage in the receptacle (5) provided at the end of the second arm (2).

This receptacle has a frustoconical housing (21) containing three balls (22, 23) distributed with an offset of 120 degrees around the median axis.

These balls (22, 23) are pushed in the direction of the bottom (26) of this conical housing (21) by a spring (25) bearing on the bottom of the receptacle (5). These balls come to block the movement of the needle (4) by the wedging effect resulting from the radial component of the action of the balls (22, 23) on the internal wall of the frustoconical housing (21).

The balls (22, 23) are metal and optionally magnetic. When an opener comprising a powerful magnet or an electromagnet is brought close to the bottom of the receptacle (5), the magnetic force opposes the effect of the spring (25), which reduces the wedging effect of the needle (4) and makes it possible to release the needle, and therefore to unlock and then open the device.

To prevent axial impacts exerted on the bottom of the receptacle, by abruptly striking the device on a hard surface, unexpectedly moving the balls and releasing the needle, various solutions are proposed.

The first consists of orienting the longitudinal axis defined by the needle (4) and receptacle (5) at an angle with respect to the transverse plane of the device, for example an angle of 10 to 35 degrees with respect to the perpendicular, so that a front impact does not occur in the movement axis of the balls (22, 23).

Figure 5:
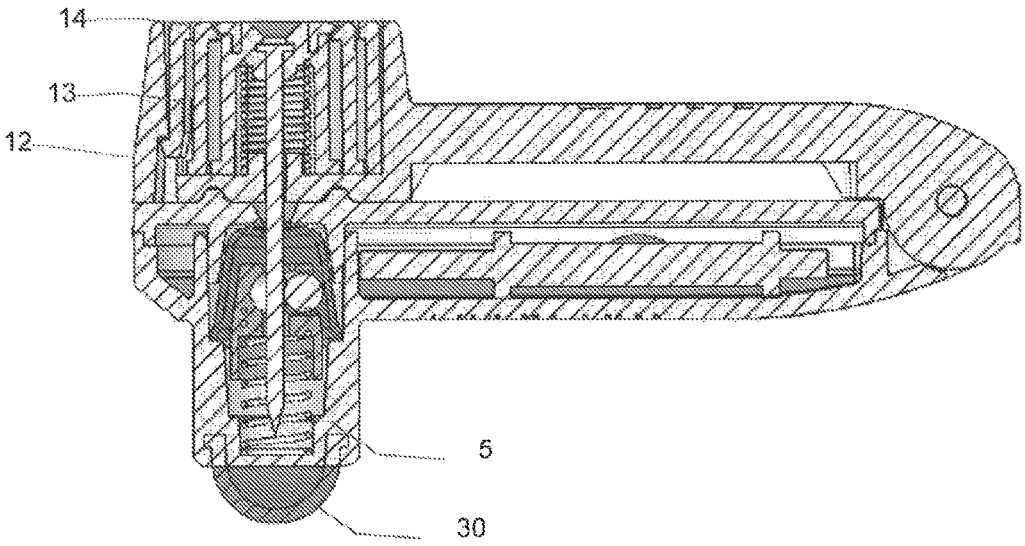
FIGS. 5 and 6 depict views in cross-section of the closed device according to two alternative embodiments

Another solution is described with reference to FIGS. 5 and 6.

The bottom of the receptacle (5) is extended by a damped zone. This is, in the example illustrated by FIG. 5, an elastically deformable additional piece, for example a hemisphere made from rubber (30).

Figure 6:
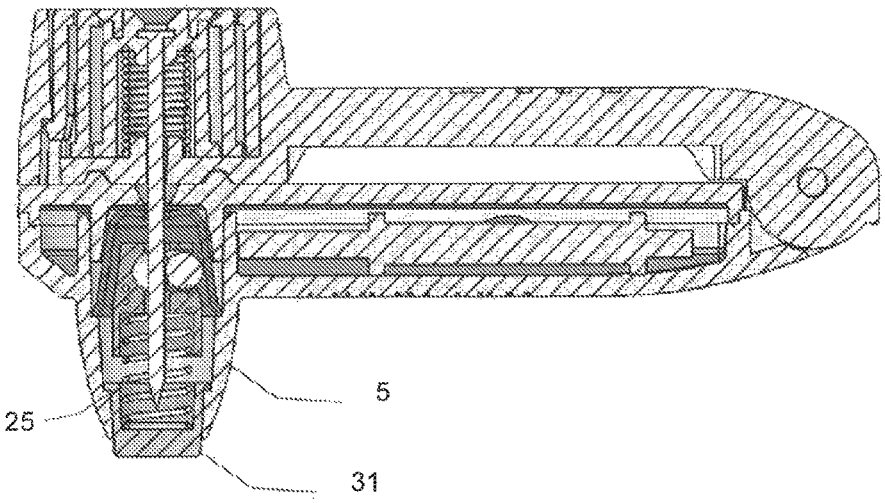
Figure 7:
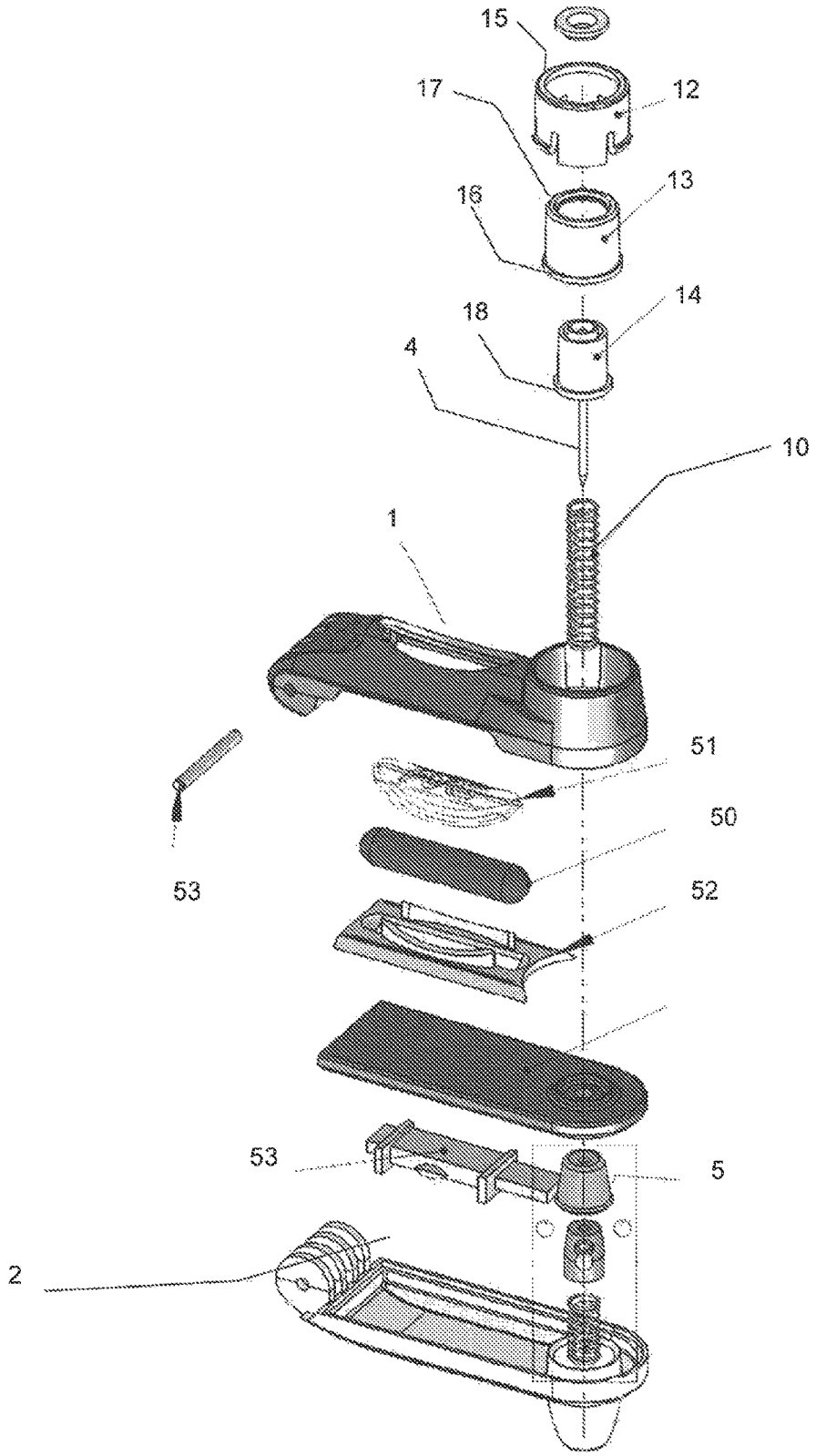
FIGS. 7 to 10 depict an exploded view, views in transverse section and longitudinal section, and a plan view of an antitheft device according to a variant embodiment where the arms contain an ink cartridge
Figure 8:
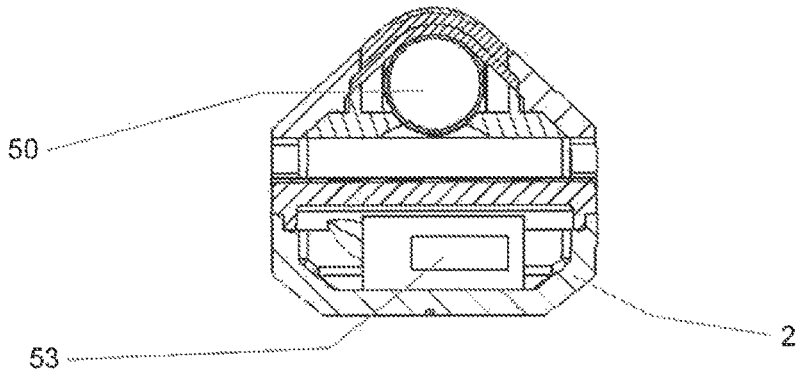
Figure 9:
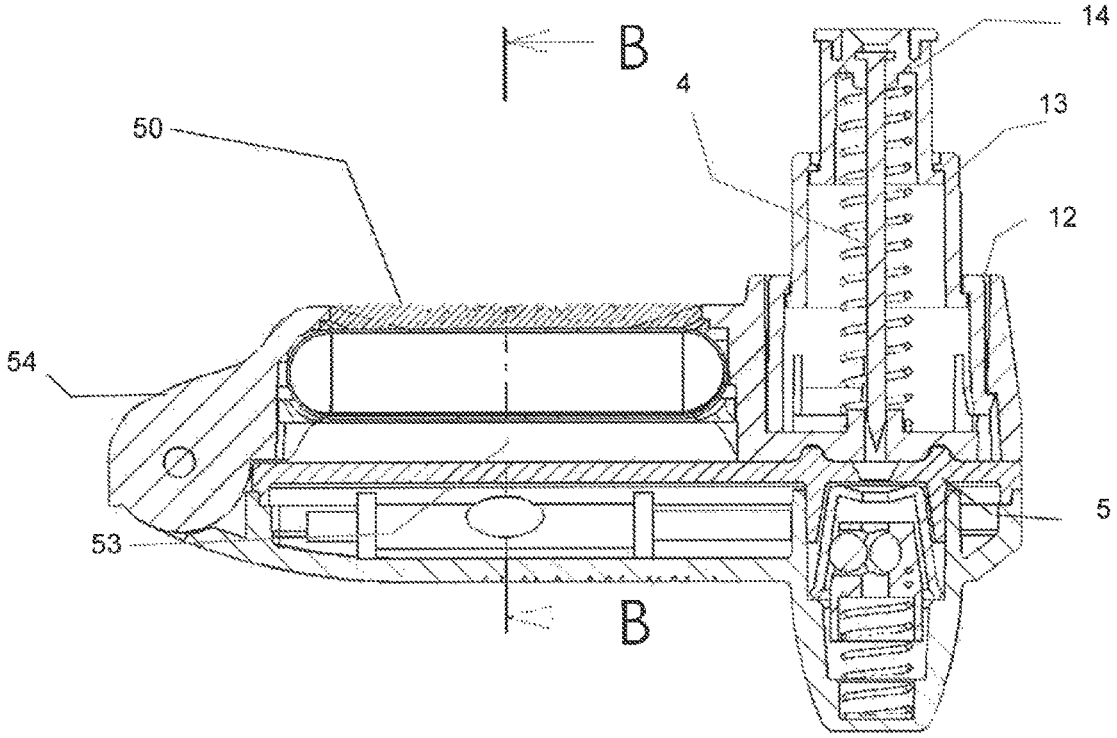
Figure 10:
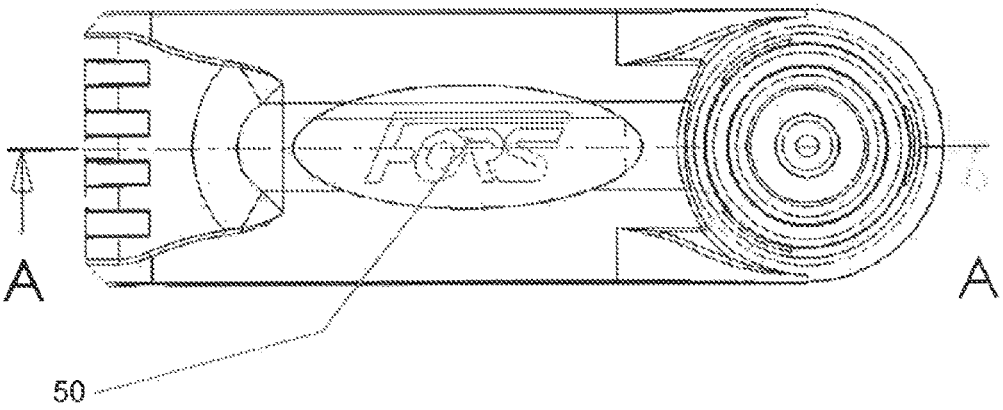

An alternative illustrated by FIG. 6, consists of providing, in the bottom of the receptacle (5), a closed cage (31) in which the spring (25) comes to bear.

FIGS. 7 to 10 depict an exploded view, views in transverse section and longitudinal section, and a plan view of an antitheft device according to a variant embodiment in which one of the arms contains a cartridge (50) filled with a marking substance.

This substance may be an indelible ink, optionally under pressure. In the event of an attempt to destroy the antitheft device, for example with a cutter used for breaking the arm (1), or a lever inserted between the article and the arm in order to force it, the cartridge (50) breaks and releases its content onto the protected article, thus definitively removing its value from it, but also on the hands of the thief. The ink capsule (50) is transparent to enable the ink to be seen.

The cartridge (50) may also contain an odorous substance, for example a liquid with a foul odour, facilitating identification of the thief and providing a presumption of an attempt at theft.

The cartridge (50) is transparent in order to make the persons tempted to commit fraud aware of the consequences of their act. It is protected by a transparent sheet (51) and rests on a cradle (52).

The second arm (2) incorporates an electromagnetic element (52) interacting with the antenna of the walk-through scanners placed at the entrances and exits of the shop. The two arms (1, 2) are articulated by means of a spindle (54).

Figure 11:
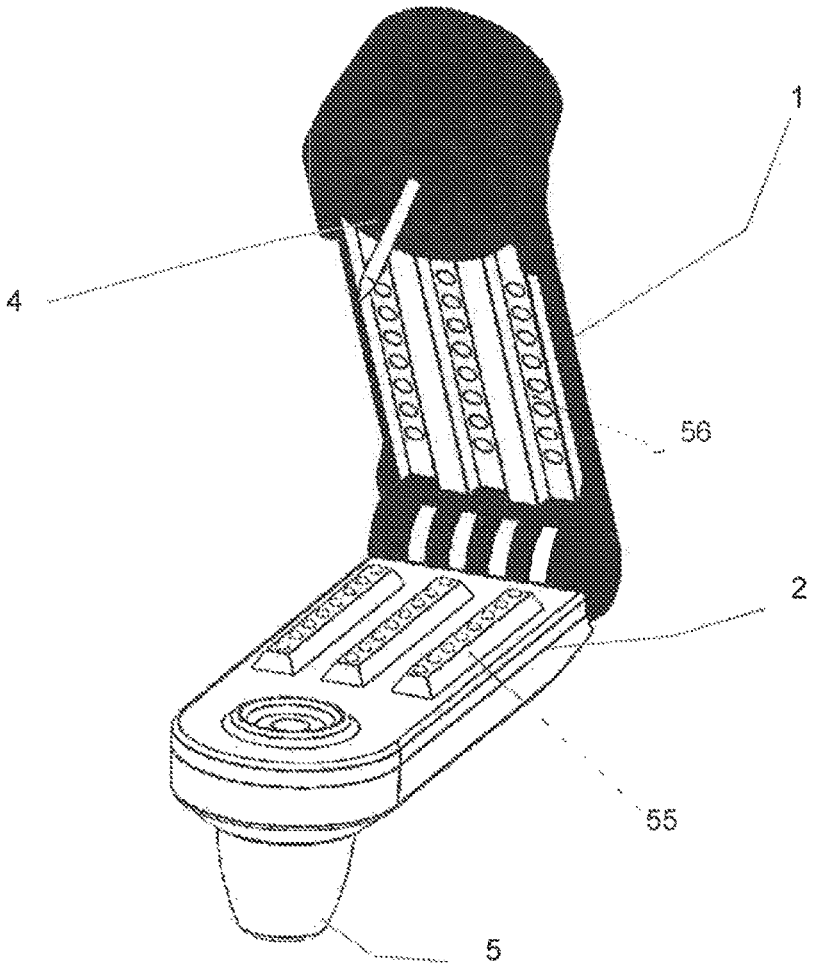
FIG. 11 depicts another variant embodiment of an antitheft device intended for fabrics or garments

FIG. 11 depicts another variant embodiment of an antitheft device intended for fabrics or garments.

The internal surfaces of the arm (1, 2) have complementary surface elements (55, 56) for reinforcing the holding of an article having a thin deformable zone such as a fabric or garment.

These surface elements have protuberances (55) with a shape complementary to the shape of the hollows (56) provided on the internal surface of the opposite arm.

Figure 12:
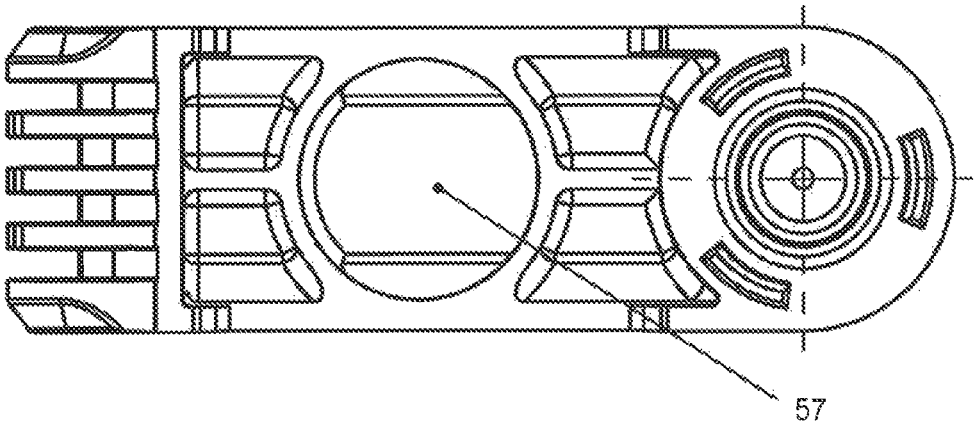
FIGS. 12 and 13 depict plan views of an antitheft device with a transparent window and of this antitheft device protecting an article.
Figure 13:
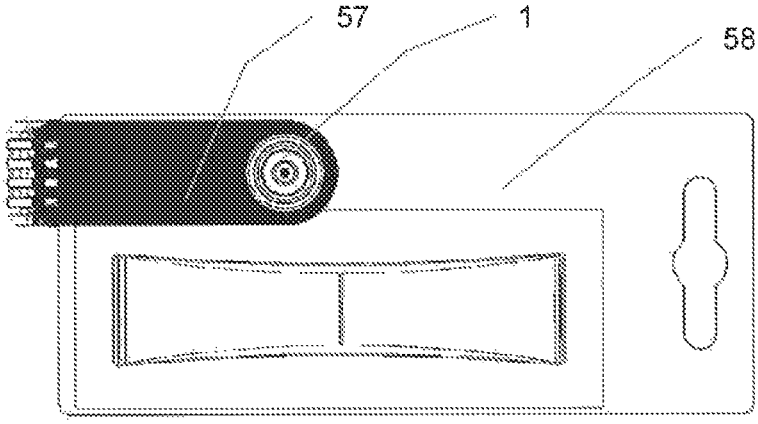

FIGS. 12 and 13 depict plan views of an antitheft device with a transparent window (57) and of this antitheft device protecting an article. The body of the antitheft device may be either completely transparent, or self-coloured, with a window (57) passing through one of the arms (1) to allow reading of information printed on the packaging (58) of the article to be protected.

Figure 14:
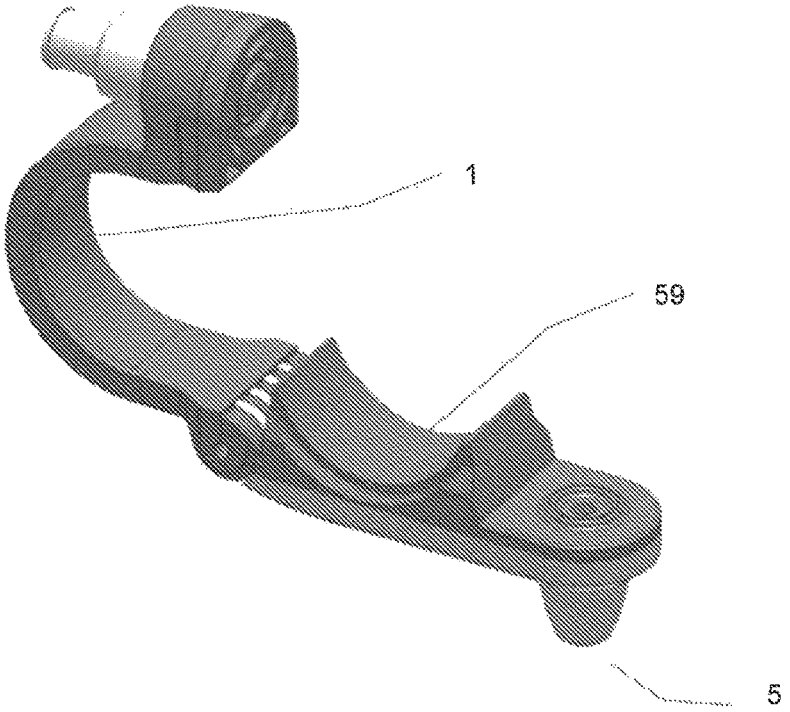
FIGS. 14 and 15 depict plan views of an antitheft device for protecting bottles
Figure 15:
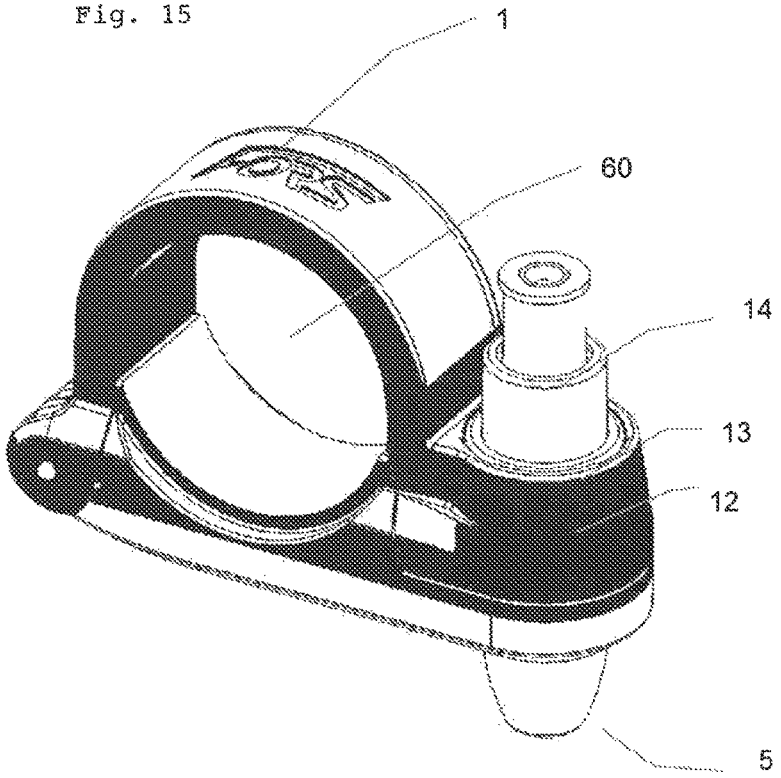

FIGS. 14 and 15 depict plan views of an antitheft device for protecting bottles.

One of the arms (1) has an arched shape with a cross-section in a semicircle, with a radius corresponding to the outside radius of a bottle neck for example. The other arm (2) has a cradle (59) with a complementary profile. When the antitheft device is closed, it determines a tubular space (60) that can grip a cylindrical part of an article to be protected.

The various antitheft devices may be grouped together in order to form a set of antitheft devices, being distinguished by a colour code, for example by the colour of the plastics material or by a coloured pellet.

Figure 16:
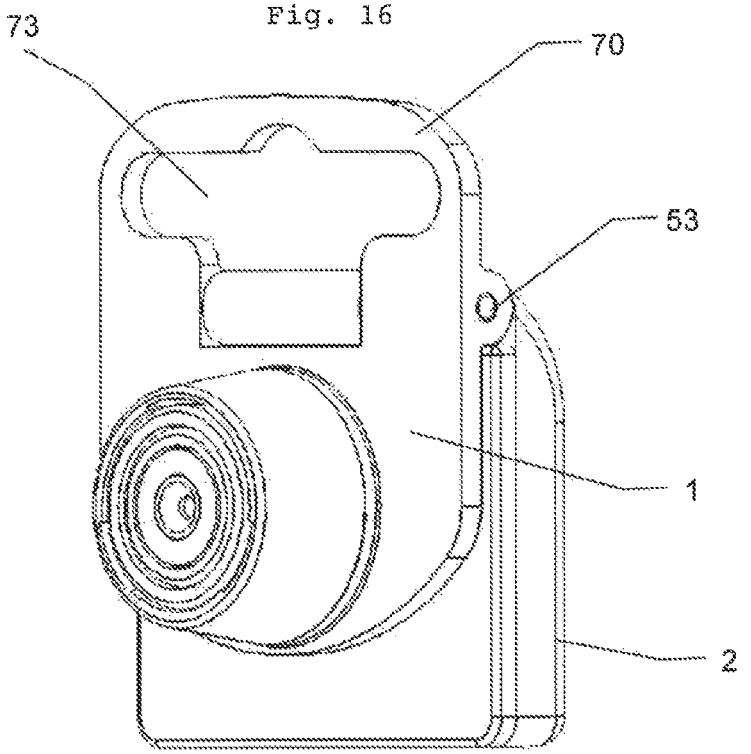
FIGS. 16 to 18 depict views of another variant embodiment of the invention
Figure 17:
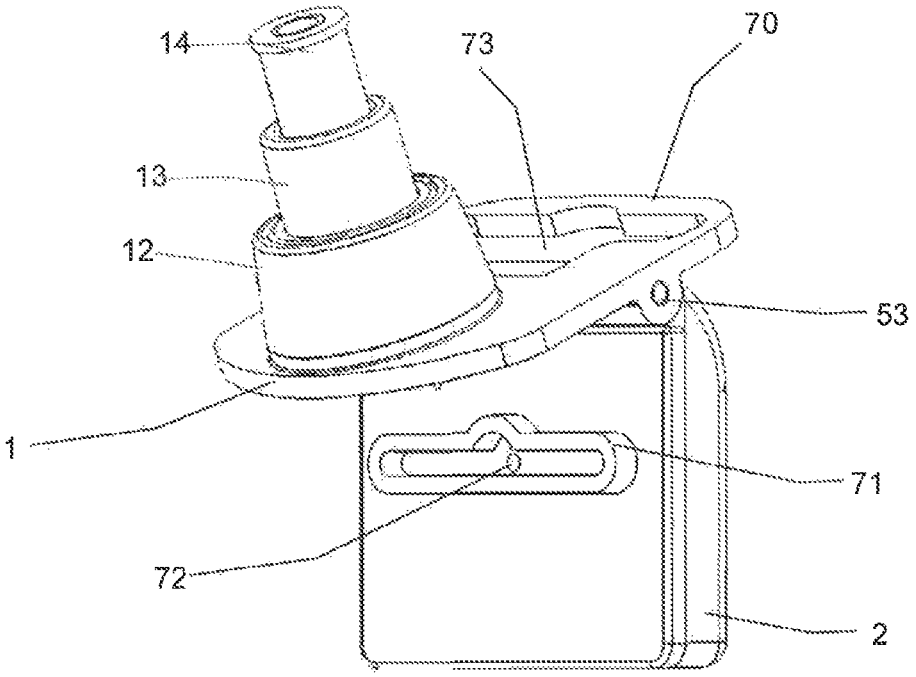
Figure 18:
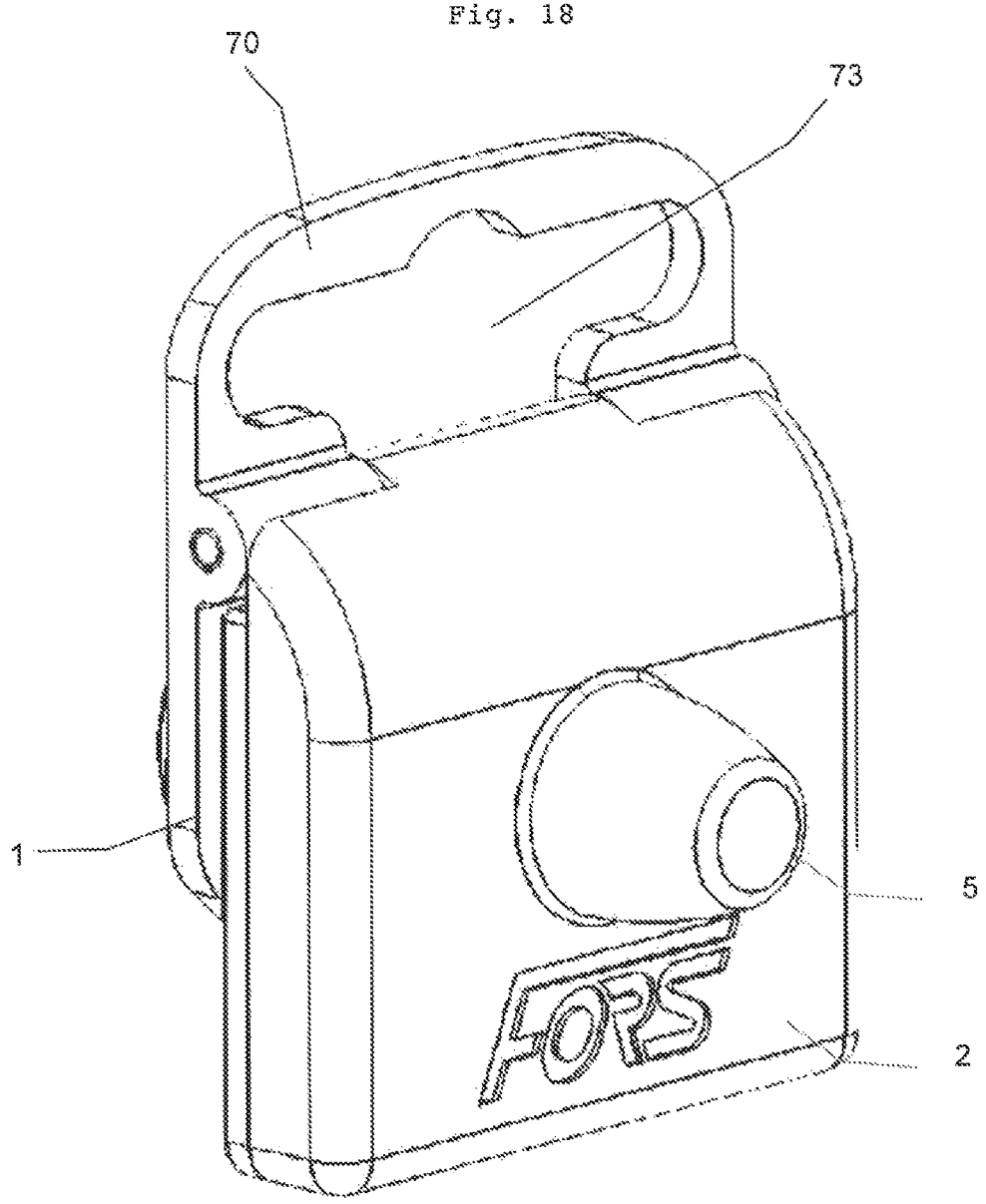
Figure 19:
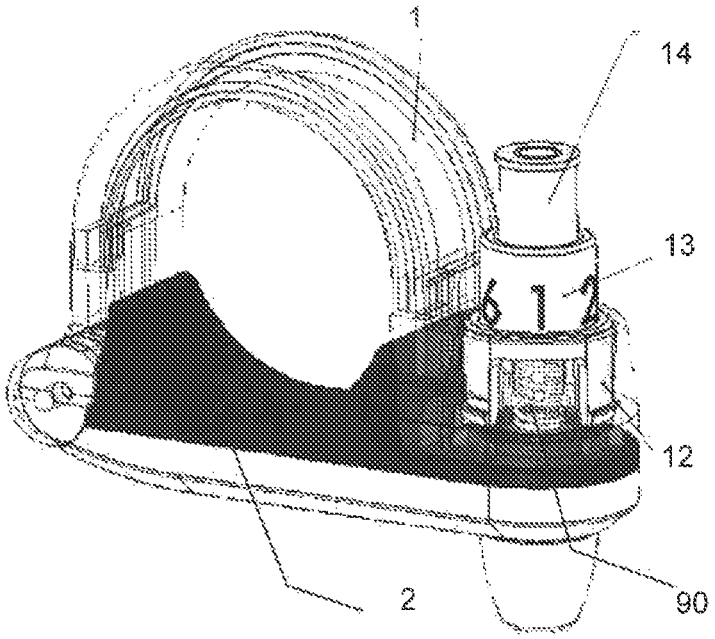
FIGS. 19 to 22 depict views of another variant embodiment of the invention, with indexed coding
Figure 20:
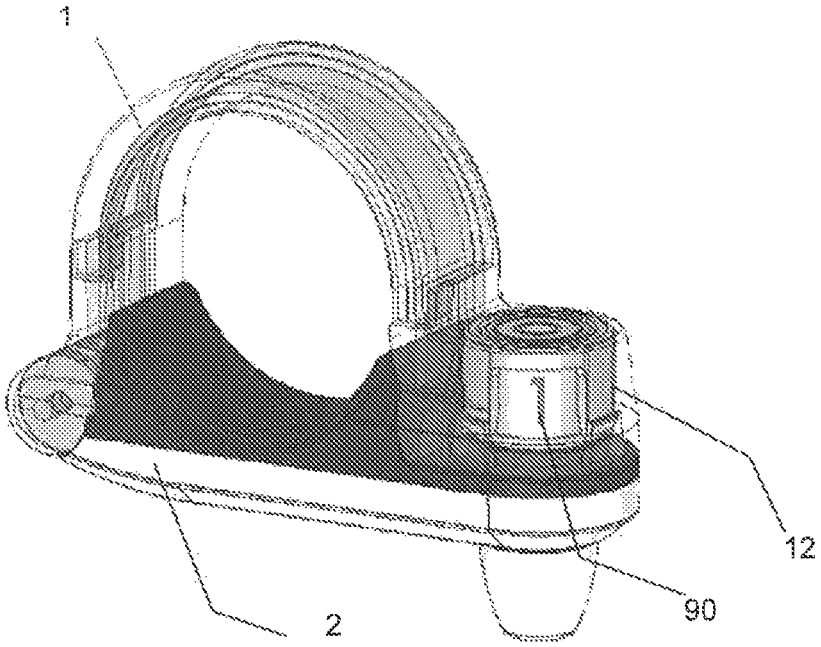
Figure 21:
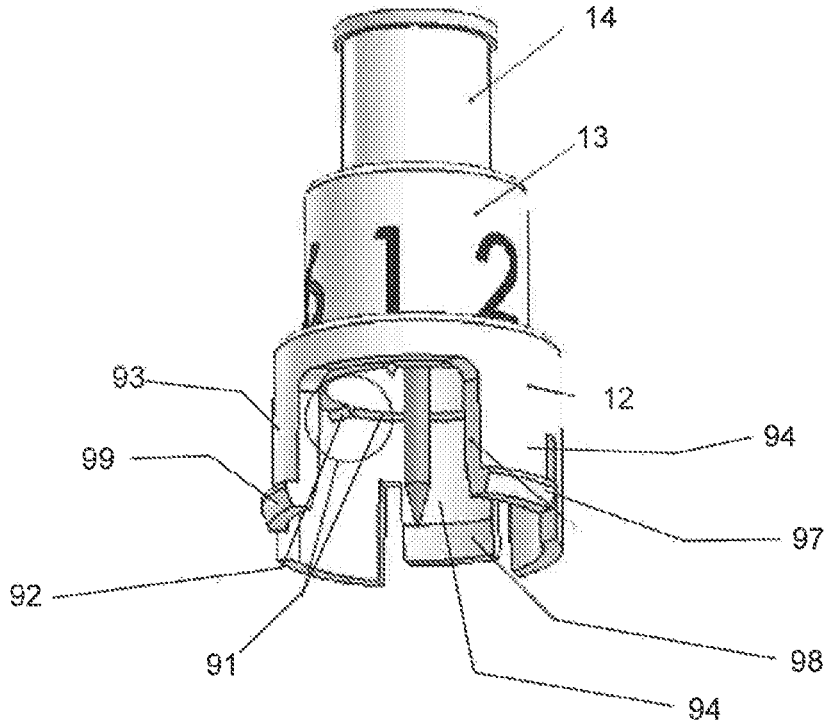
Figure 22:
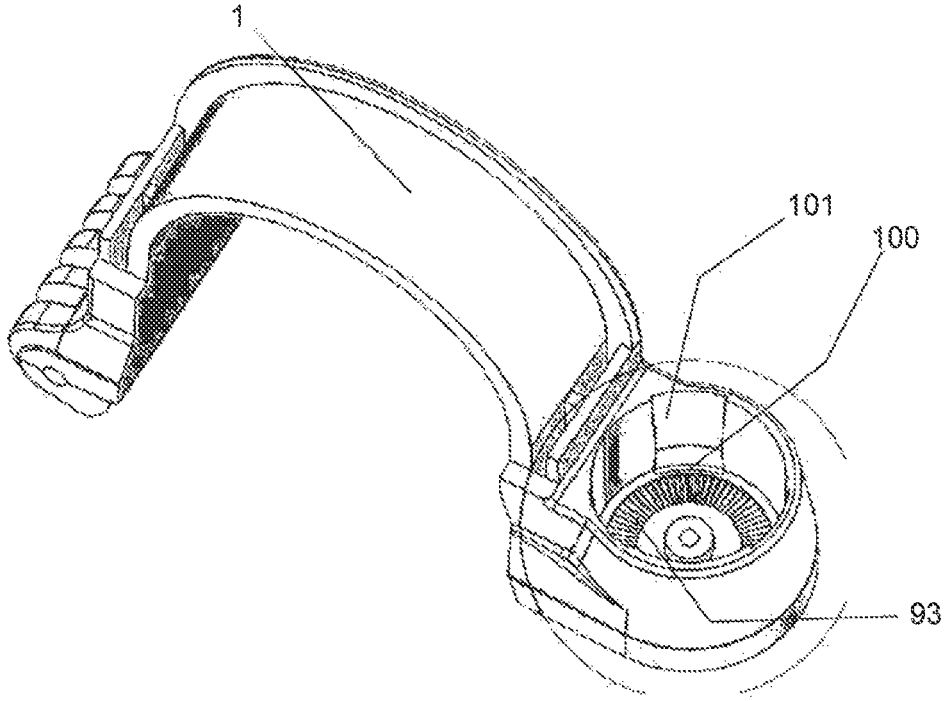
Figure 23:
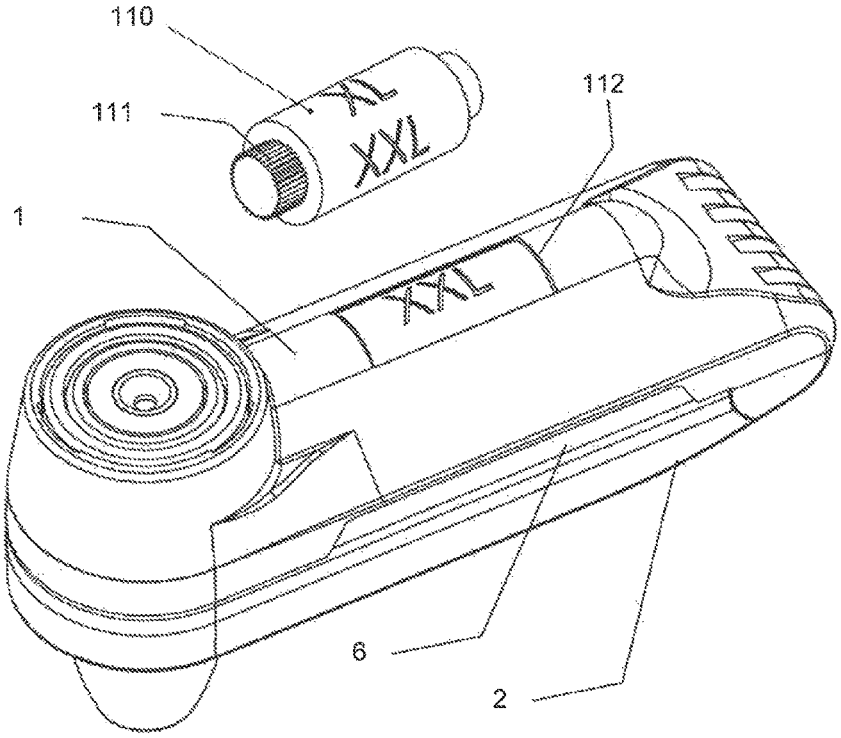
FIG. 23 depicts an exploded view of another variant embodiment of an antitheft device with an indexing wheel

FIGS. 16 to 18 show views of another variant embodiment of the invention respectively from the front, in the open position and from the rear, for protection against the theft of articles presented in plastic shells with a top part having a slot for attachment to the rods of a display unit.

The device consists of two parts (1, 2) with a rectangular shape, connected by a spindle (53).

One of the parts (1) is provided with retractable elements (12, 14) for moving the needle (4) between the retracted position, where its end is situated so as to be recessed with respect to the internal surface of the part (1), and a locking position in which it passes through the blister pack of the article and penetrates the locking member (5) by passing through a hole (72) provided in the second part (2).

The internal surfaces of the rectangular parts (1, 2) have complementary regions (71) for locking the blister-pack attachment slot.

The top part of the device has a zone (70) provided with an aperture (73) having the general form of the attachment cutout with which the blister packs are provided.

The blister pack is introduced when the two parts (1, 2) are open and the needle (4) retracted. The blister-pack attachment cutout is then positioned in the complementary zone (71) and the two parts (1, 2) are closed again. Next the needle (4) is pressed in by pressing on the retractable parts (12 to 14) until the end of the needle is introduced into the ball locking system (5).

FIGS. 19 to 22 depict views of another variant embodiment of the invention, with indexed coding.

This variant makes it possible to reveal coding with respect to the value of the object protective. This is because thieves replace the bar code label on the bottle with a bar code label of a bottle with a lower price. Since this claim of theft is very difficult to detect at the till, secure marking on the antitheft device associating a digit or digits or letter or letters in relation to the value of the object (e.g.: coding 1→price between 1 and 10 euros—coding 2→price between 10 and 20 euros, etc) enables the checkout girl to immediately have a relationship between the real value of the bottle and the price related to the bar code. If the bottle is scanned at 9 euros and coding is 4 (price between 30 and 40 euros).

For this technical solution the top movable body must necessarily be transferred.

The button and the coding ring being free to rotate, we have the possibility, when the device is unlocked, to be able to freely manipulate (in rotation) the coding ring. According to the coding design, turning the ring until the marking is situated vertically above the coding window.

At this stage, all the codings remain visible. After having positioned the device on the bottle, the pressure exerted on the button to engage the nail in the ball lock will drive the button/coding ring assembly downwards. This action enables the preselected coding to be the only one visible through the coding window formed in the bottom ring.

Despite the fact that coding ring is no longer easily accessible, we can, by exerting a rotation pressure on the button region (locked), succeed in changing the coding. This problem has been solved by associating teeth (3 teeth in relief at 120°) on the coding ring and a hollow serrated circular zone in the transparent movable body. This is because, during locking, the coding ring is pressed against the transparent movable body at the tooth zone formed in the two pieces. This association of pieces prevents modification to the coding after locking.

This example relates to an antitheft device for bottles, but the serration proposed is not limited to this application but applies more generally to any application of an antitheft device with a needle that can be actuated by retractable cages. The part (1) is transparent so as to prevent masking of the cap surrounding the neck of the bottle.

This variant relates to the fact that the tubular wall of the external cage (12) has a cutout (90) extending, in the example described, over an angular width of approximately 40°.

The intermediate cage (13) carries markings distributed over the external surface of the tubular wall, in the example described a series of digits, characters, signs or colours.

The marking carried out on this ring may in particular give an indication on the size of a garment by associating the lettering S/M/L/X/XL/XXL, or price range, or promotion.

When the device is in the open position, the intermediate cage can be moved angularly in order to make one of the markings of the intermediate cage correspond to the cutout (90) of the external cage.

When the cages (12 to 14) are in locking position, one of the markings is visible through the window (90).

The bottom front surface (91) of the intermediate cage (41), and more precisely of its annular rim, has one or more positive-location teeth (92). These positive-location teeth (92) cooperate with a notched surface (93) provided on an annular zone of the floor of said part (1).

In this example embodiment, the external cage (12) has a split tubular skirt, forming tabs (94 to 96), the bottom end of which is provided with hooks (97 to 99).

These tabs anchor the external cage (12) on the part (1). This part (1) has a housing, the tubular skirt of which has ribs (101), the bottom of which has slots (100). The external cage (12) is thus clipped in the part (1).

FIG. 3 is another variant of an antitheft device with an indexing knurled wheel. When the antitheft device is fitted on a garment, the operator moves the knurled wheel (110) by turning it until it reaches the required size.

This knurled wheel forms an integral part of the top movable subassembly (1), having a window (112) cut out so as to enable one of the marks placed on the knurled wheel (110) to be read.

A system of serrations (111) between the part able to rotate and its housing prevents the knurled wheel from turning when not wanted.

This is because only the force exerted on the knurled wheel (110) by the operator in order to rotate it makes it possible to release the two serrated parts (111).

When the antitheft device is in the locked position, the force is exerted by the article gripped in the cavity (6) provided between the first part (1) and the second part (2) pushes the knurled wheel (110) into its housing and, by means of the teeth (111), blocks the rotation of the knurled wheel (110).

Figure 24:
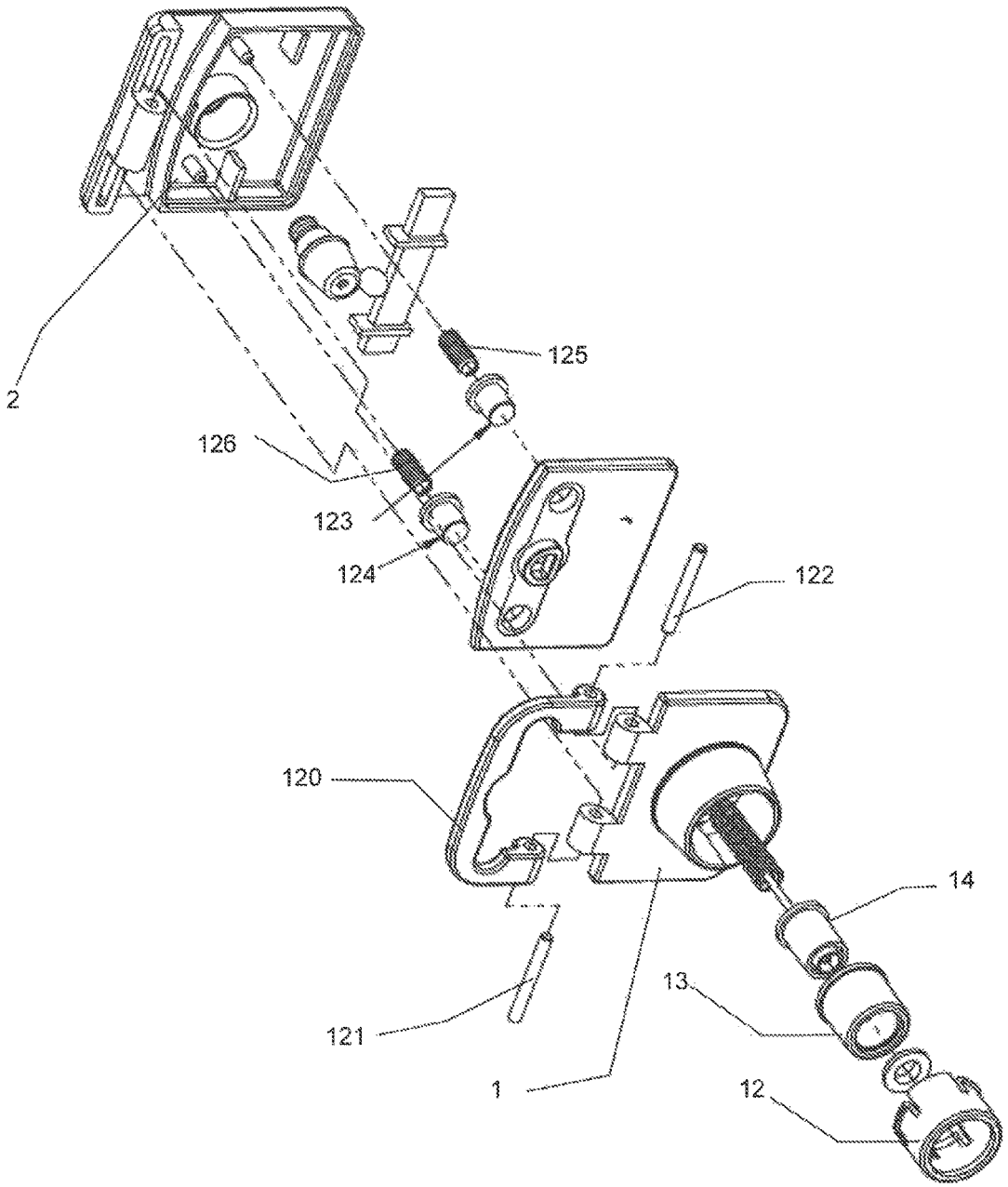
FIG. 24 depicts an exploded view of another variant embodiment of an antitheft device for protecting suspended articles

FIG. 24 depicts an exploded view of another variant embodiment of an antitheft device for protecting suspended articles, packaged in "blister pack" form (trade name).

This variant has two parts (1, 2), one of which is provided with a tilting hook (120) in order to be able to emerge from the pin more easily and without risk of breaking the hook. The articulation of the hook (120) thus prevents it producing a lever effect that could weaken the device.

This hook (120) is articulated with respect to the part (1) by means of two pivots (121, 122) also providing the articulation between the first and second parts (1, 2).

The device has, on the internal surface of one of the parts (2), two retractable studs (123, 124) mounted on springs (125, 126). These studs (123, 124) make it possible to fit blister packs having attachment orifices with different shapes and thicknesses and to adapt the size of the cavity formed between the two parts to the configuration of the article to be protected, without any unnecessary clearance.

This solution also makes it possible to preserve an attachment surface that is as large as possible in order to resist the tearing away of the blister pack by the thief. The form of the standard hook enabled three studs to pass, which is not the case for the other forms of attachment (round hole or triangular shape). The retractable lateral studs (123, 124) make it possible to position a great variety of attachment forms. The form of the body for also making it possible to accept blister packs with a rim rather than a flat shape.

FIGS. 25 to 28 depict views of another variant embodiment of the invention, for the protection of articles such as shoes, lingerie articles, articles having a closed tube, etc.

According to this variant, one of the parts (2) has a housing (131) receiving the end of a loop (130) produced from a material resistant to cutting, in particular a steel loop. The opposite end of this loop (130) has a piercing (132) that the needle (4) can pass through.

This device uses the same locking base as the other variants and makes it possible to adapt the antitheft device to the protection of a wide range of articles with a minimum number of technical modifications.

Figure 25:
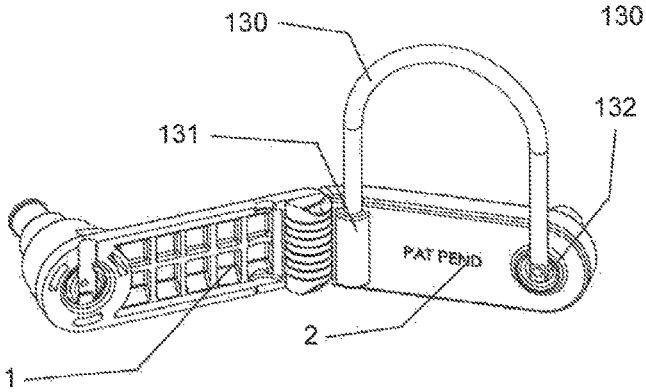
FIGS. 25 to 28 depict views of another variant embodiment of the invention, for protecting articles with a loop
Figure 26:
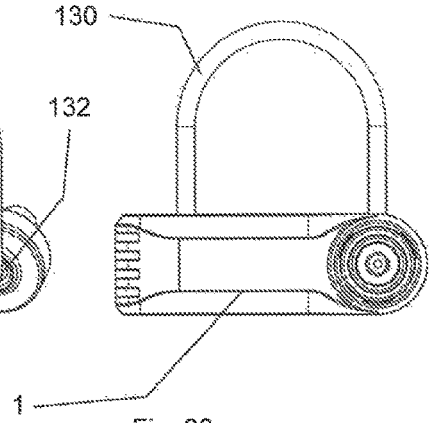
Figure 27:
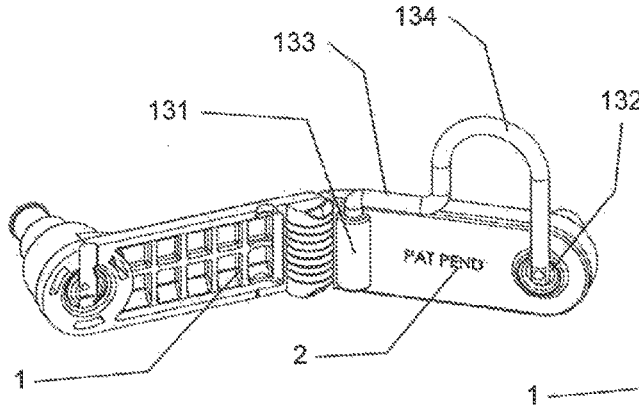
Figure 28:
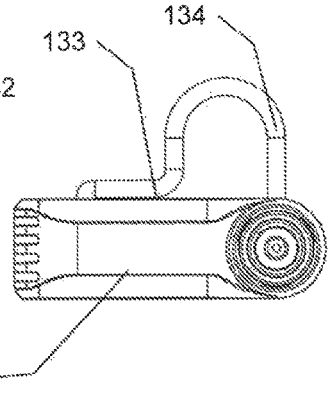

The loop may have a U shape as depicted in FIGS. 25 and 26, or more elaborate shapes, as depicted in FIGS. 27 and 28, for example a form with a loop (133) of reduced width extended by a bridge (134).

Figure 29:
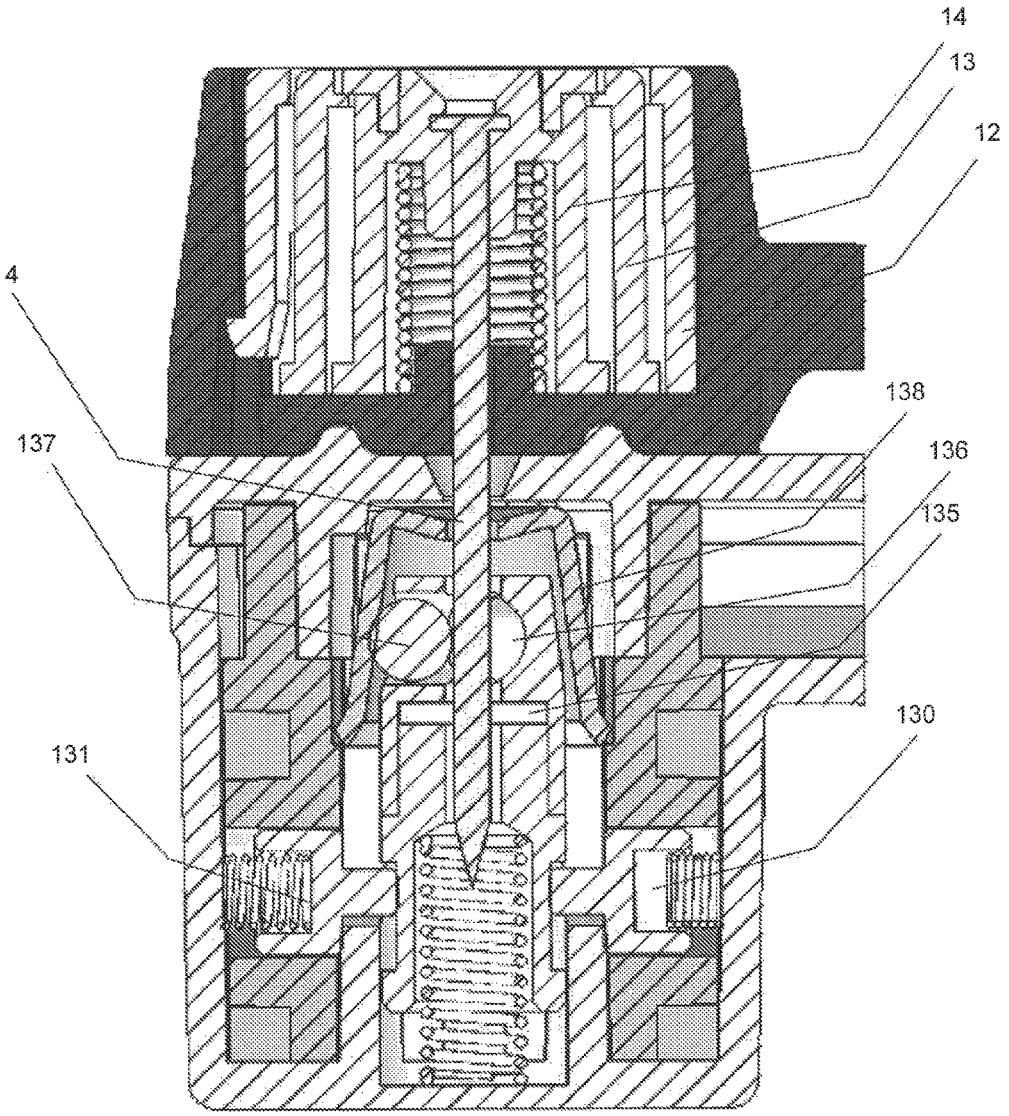
FIGS. 29 to 30 depict views of another variant embodiment of the invention with increased security
Figure 30:
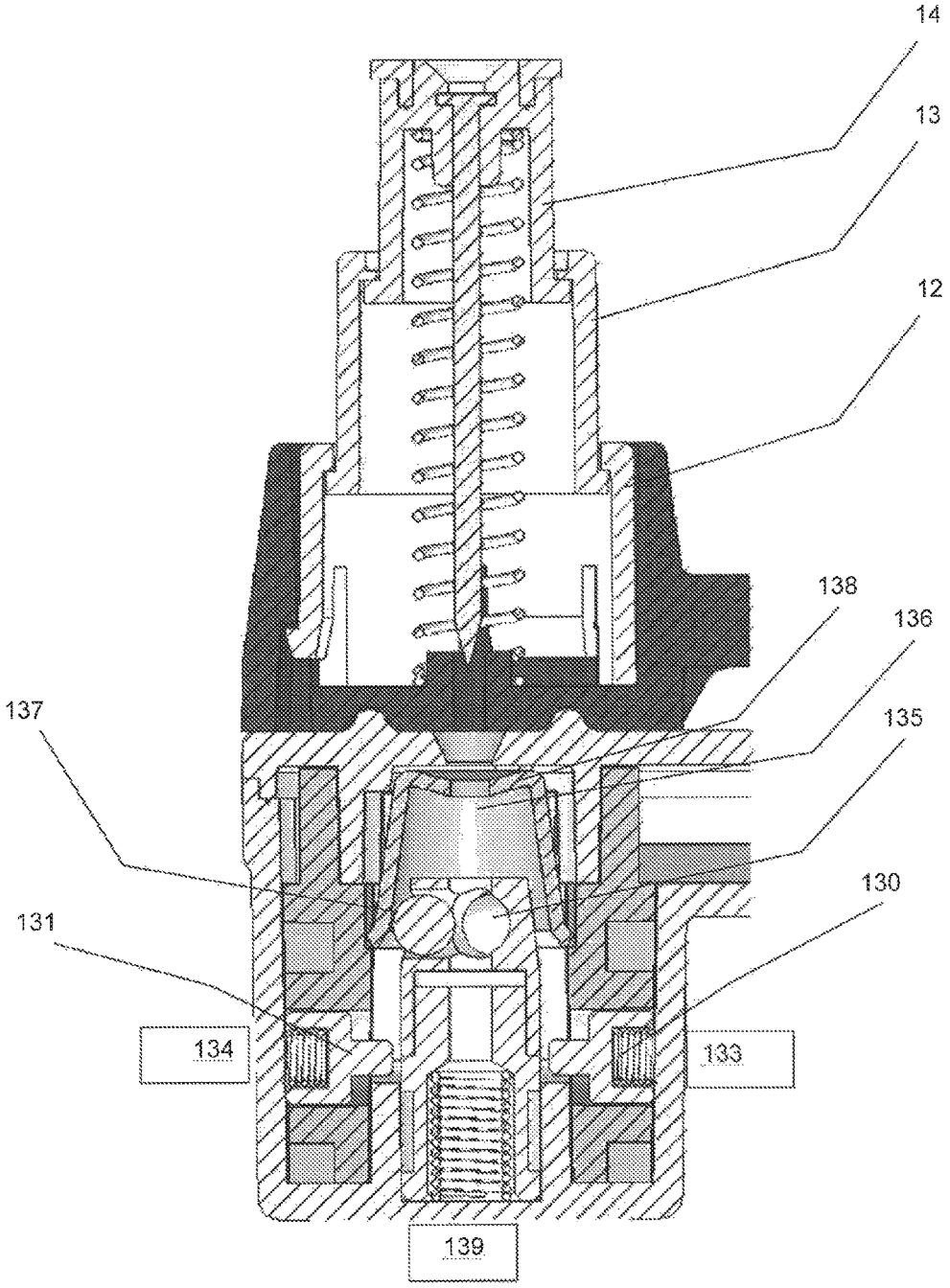

FIGS. 29 to 30 depict views of another variant embodiment of the invention with increased security, depicted respectively in the locked position and in the unlocked position.

To enable the system to be unlocked, the use of three magnets simultaneously is obligatory.

This is because, if the lateral weights (130, 131) are not attracted by the lateral magnets (133, 134), the vertical subassembly consisting of the main weight (135), the ball cage (136) and the balls (137, 138) cannot descend under the action of the bottom magnet (139). The descent of this subassembly releases the pressure exerted on the nail by the balls (137, 138).

Naturally the number of lateral weights may be fixed between 1 and N, and a regular distribution or not for increasing security.

Figure 31:
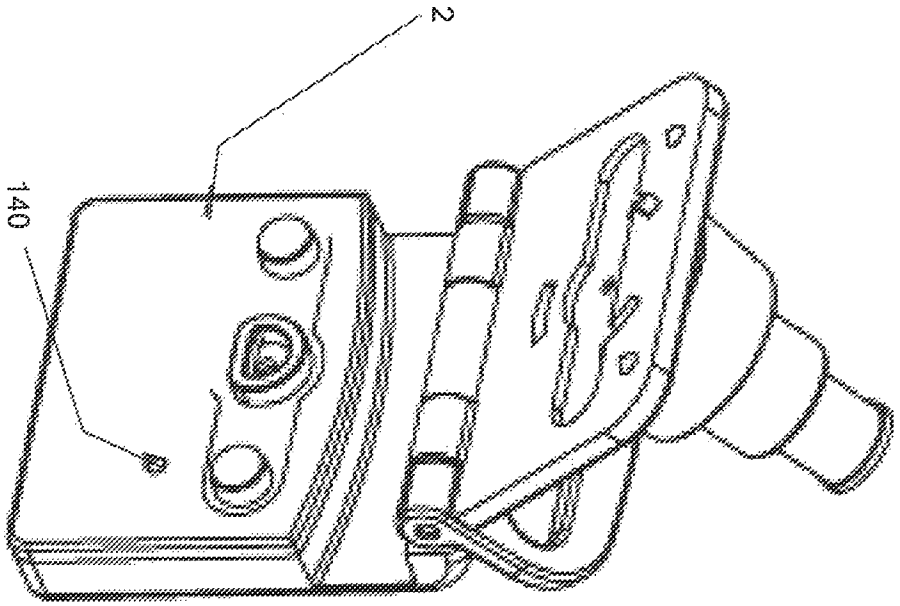
FIG. 31 depicts a view of another variant embodiment of an antitheft device with an alarm
Figure 32:
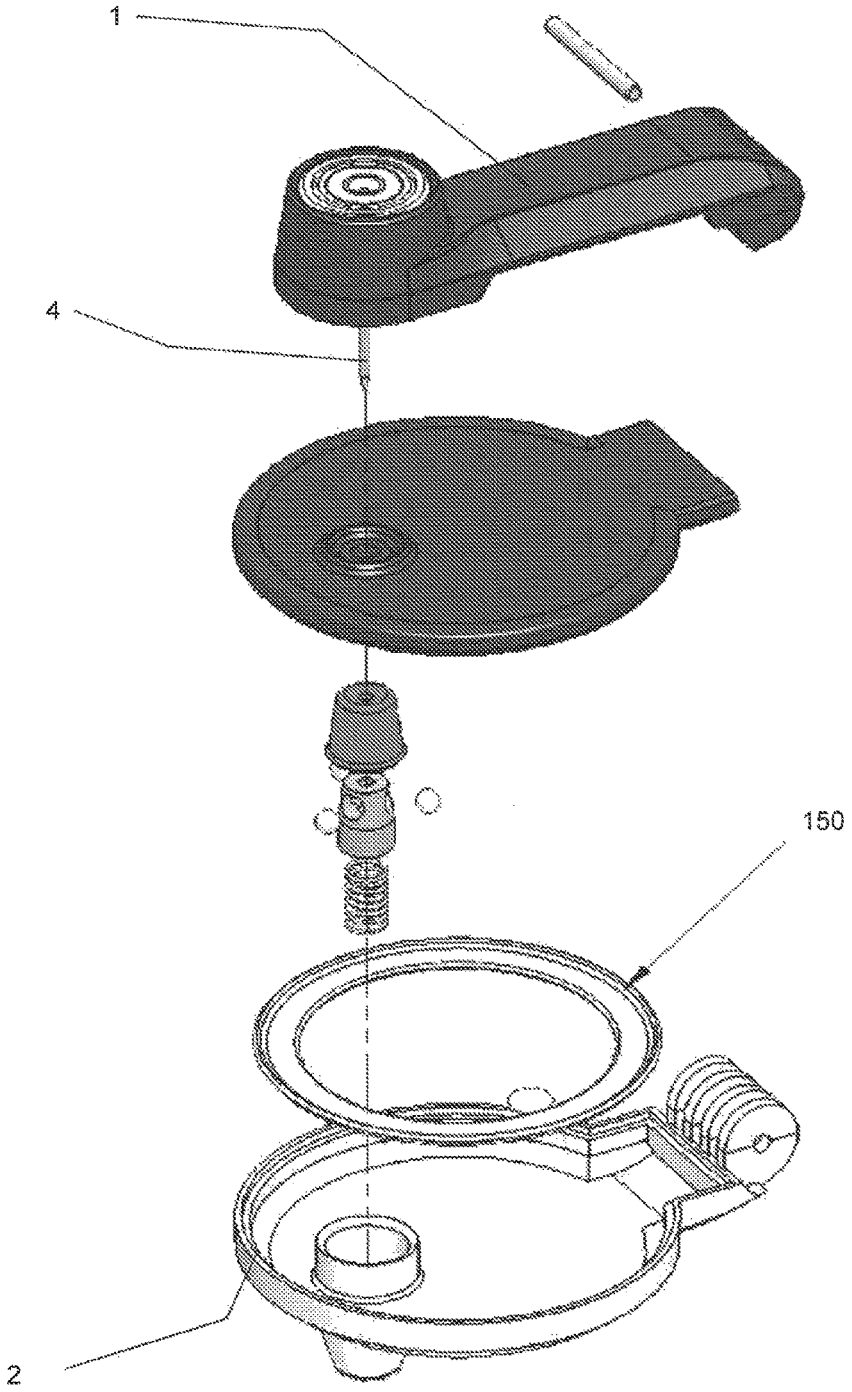
FIG. 32 depicts a view of another variant embodiment of an antitheft device with an annular coil.
Figure 33:
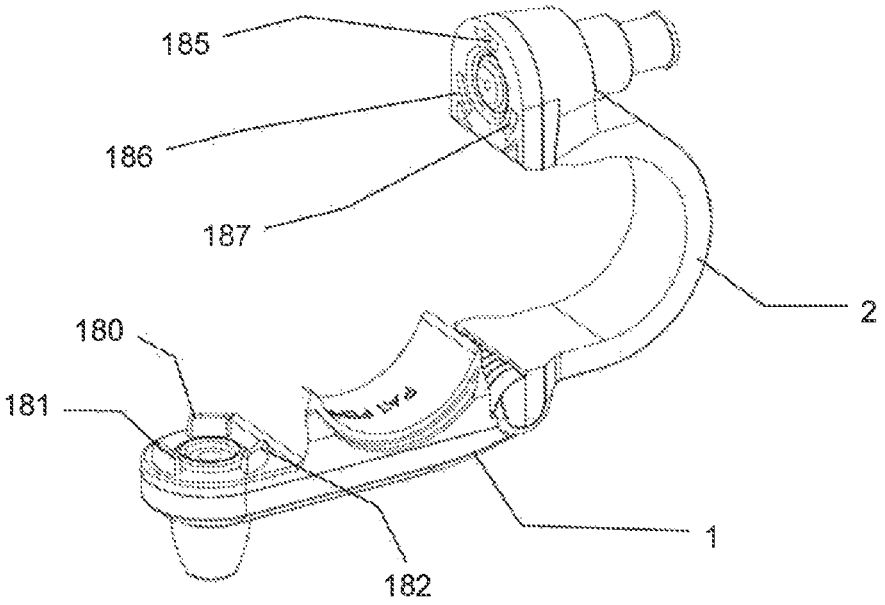
FIGS. 33 to 34 depict views of another variant embodiment of an antitheft device.
Figure 34:
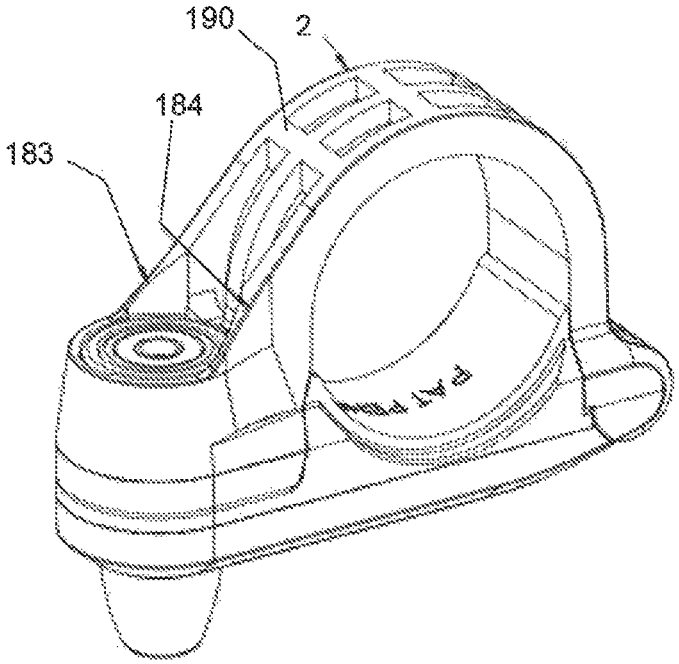

FIG. 31 depicts a view of another variant embodiment of an antitheft device with an alarm. One of the parts (2) contains an electronic circuit integrated in the body, with a power supply and a noise generator. A sensor (140) detects the closure of the device and the abutment of a protected article between the two parts (1, 2). The alarm is activated when the device is closed. In the open position, it is on standby until a first closure activating the alarm. In the event of forcing of opening, the sensor (140) is released and triggers the alarm. Deactivation under the control of the sales assistant is effected by the detection of a magnetic field or a remote deactivation release.

This circuit will be equipped with a sensor making it possible, when the blister is fitted, for the pressure exerted by the closure of the movable part and the blister to activate the alarm by means of the sensor. When there is an attempt at breaking in, either by pulling away the blister or an attempt to pull away the nail, the sensor is released and triggers the alarm.

FIG. 31 depicts a view of another variant embodiment of an antitheft device with an annular coil (150). One of the parts (2) has a disc form to receive a large annular coil (150), increasing the efficacy of detection.

The invention also relates to an antitheft system comprising a locking system common to a range of products, and a plurality of components forming first and second parts with variable shapes. The locking system consists of a first assembly comprising the cages (12 to 14) that can be fitted together and the nail (4), and a second assembly consisting of the system for locking the nail by means of balls.

The first assembly may consist of a component snapping onto one of the parts. The second assembly may also consist of a component able to be snapped onto the opposite part.

This solution reduces the tooling costs for supplying a wide range of antitheft products.

The invention claimed is:

1. An antitheft device configured for attachment to an article sold over the counter, formed by two parts, one of which comprises a means for remote interaction with a terminal detecting the passage of such a device, said parts being articulated by a hinge to allow movement between a protection position in which the antitheft device interacts with a part of the article to be protected in order to prevent separation of the antitheft device and the article, and a release position configured to enable the article to be removed, a first part having, at the end opposite to said movable hinge, a needle able to move in a direction perpendicular to the mid-plane of the device, the other part comprising a housing for receiving said needle, the housing comprising locking means configured to allow the release of said needle by means of an opener, wherein said first part has three retractable cages enabling said needle to move between a retracted position where the tip of said needle does not project beyond the internal surface of the first part, and a deployed position in which said needle is engaged in the complementary housing when the device is in the closed position, an external cage of said three retractable cages being fixed, an intermediate cage of said three retractable cages being moveable in axial translation with respect to the external cage and an internal cage of said three retractable cages being moveable in axial translation with respect to the intermediate cage.

2. Antitheft device according to claim 1, wherein the external cage has an internal hollow volume corresponding to an external volume of the intermediate cage, said intermediate cage having an internal hollow volume corresponding to the external volume of the internal cage, the height of the intermediate cage being configured so as not to project beyond the top front surface of the external cage, the height of the internal cage being configured so as not to project beyond the top front surface of the external cage and the intermediate cage in the locking position.

3. An antitheft device according to claim 1, wherein the locking means consist of at least one ball pushed by a spring towards the bottom of the housing intended to receive the needle, said housing having a frustoconical shape configured to cause wedging of the ball against the needle, said ball being able to interact with an unlocking means to oppose the action of said spring.

4. An antitheft device according to claim 1, wherein the locking means further comprises a means for lateral locking of a frustoconical housing, said lateral locking means being able to interact with an unlocking means in order to release the axial movement of said housing.

5. An antitheft device according to claim 1, wherein one of said parts contains a capsule filled with a marking substance.

6. An antitheft device according to claim 1, wherein one of said parts has at least one transparent zone.

7. An antitheft device according to claim 1, wherein at least one of said parts has on its internal surface a surface finish reinforcing the mechanical interaction with the article to be protected.

8. An antitheft device according to claim 1, wherein said parts have on their internal surfaces complementary surface elements reinforcing the cooperation with a thin deformable article to be protected.

9. An antitheft device according to claim 1, wherein said parts have an arched shape for surrounding a cylindrical zone of an article to be protected.

10. An antitheft device according to claim 1, which is formed by two rectangular shaped parts connected by a spindle, one of the parts being extended by an attachment zone, one of the parts being provided with retractable elements for moving the needle between the retracted position, where its end is recessed with respect to the internal surface of the part, and a locking position in which it passes through the attachment cut out of the blister pack of the article and penetrates the locking member by passing through a hole provided in the second part.

11. An antitheft device according to claim 1, wherein said device constitutes one of the elements of a series of antitheft devices distinguished from one another by a coloured code.

12. An antitheft device according to claim 1, wherein the bottom front surface of the intermediate cage has one or more positive-location teeth configured to cooperate with a notched surface provided on an annular zone of the floor of the part.

13. An antitheft device according to claim 1, wherein the tubular wall of the external cage has a cutout and in that the intermediate cage carries markings distributed over the external surface of the tubular wall.

14. An antitheft device according to claim 1, wherein the external cage has a split tubular skirt, forming lugs, the bottom end of which is provided with hooks able to anchor the external cage on the part having housings, the tubular skirt of which has ribs provided with slots for snapping on the external cage.

15. An antitheft device according to claim 1, wherein said device comprises a knurled wheel housing one of the parts having a window cut out so as to enable one of the marks affixed to the knurled wheel to be read.

16. An antitheft device according to claim 1, wherein one of the parts has, on its internal surface, at least one retractable stud mounted on springs.

17. An antitheft device according to claim 1, wherein one of the parts has a housing receiving the end of a loop, wherein the opposite end of this loop has a piercing able to have the needle passed through it.

18. An antitheft device according to claim 1, wherein the locking means comprises at least one lateral weight able to be attracted by lateral magnets, and at rest blocking the movement of a vertical subassembly consisting of a main weight.

19. An antitheft device according to claim 1, wherein one of the parts contains an electronic circuit integrated in the body, with a power supply and a noise generator, a sensor detects the closure of the device and the abutment of a protected article between the two parts.

20. An antitheft device according to claim 1, wherein one of the parts has a disc shape, for receiving a large annular coil.

* * * * *